United States Patent [19]

Lambert et al.

[11] Patent Number: 4,723,684

[45] **Date of Patent: * Feb. 9, 1988**

[54] CAN LID WITH INTEGRAL PUSH-IN TAB

[76] Inventors: G. Steven Lambert, P.O. Box 691152, Los Angeles, Calif. 90069; Michael P. Lambert, 21 Richmond St., Portsmouth, N.H. 03801

[ * ] Notice: The portion of the term of this patent subsequent to Apr. 29, 2003 has been disclaimed.

[21] Appl. No.: 857,734

[22] Filed: Apr. 29, 1986

Related U.S. Application Data

[63] Continuation-in-part of Ser. No. 704,163, Feb. 22, 1985, Pat. No. 4,585,140, which is a continuation-in-part of Ser. No. 638,874, Aug. 8, 1984, abandoned, which is a continuation-in-part of Ser. No. 500,335, Jun. 2, 1983, Pat. No. 4,465,203.

[51] Int. Cl.[4] ..... B65D 7/32

[52] U.S. Cl. ..... 220/268

[58] Field of Search ..... 220/268; 413/15

[56] References Cited

U.S. PATENT DOCUMENTS

| | | | |
|---|---|---|---|
| 3,759,206 | 9/1973 | Dalli et al. | 220/268 |
| 4,465,203 | 8/1984 | Lambert | 220/268 |
| 4,585,140 | 4/1986 | Lambert et al. | 220/268 |

*Primary Examiner*—George T. Hall

*Attorney, Agent, or Firm*—Cesari and McKenna

[57] ABSTRACT

A stamped and scored one-piece container lid with an integral push-in tear tab has a ridge embossed in the tear tab and a push location to the rear of the ridge. When the push location is depressed, the tab tears along its score line and rotates into the container. The ridge prevents the user's digit from sliding along the declining tab through the opening in the lid left by the tab and possibly contacting the sharp edge thereof. Special indentations may be formed in the lid at or near the opposite ends of the score line which make it easier to depress the tab to produce a large effective pour opening in the lid.

3 Claims, 6 Drawing Figures

CAN LID WITH INTEGRAL PUSH-IN TAB

RELATED APPLICATIONS

This application is a continuation in part of Ser. No. 704,163 filed Feb. 22, 1985 now U.S. Pat. No. 4,585,140; which is a continuation-in-part of application Ser. No. 638,874, filed Aug. 8, 1984, now abandoned, entitled CAN LID WITH PUSH-IN TEAR TAB, which is a continuation in part of application Ser. No. 500,335 filed June 2, 1983, now U.S. Pat. No. 4,465,203.

BACKGROUND OF THE INVENTION

This invention relates to a can lid with a push-in tear tab. It relates more particularly to a one-piece lid having a tab which can be pushed down into the container to form a pour opening in the lid without separating from the lid.

1. Field of the Invention

The lids of the type with which we are concerned are used to form the top walls of cans or other containers for a variety of different products such as beverages, powdered or granualted materials and the like which may be maintained in the container at or above atmospheric pressure. The invention is particularly applicable to lids for cans containing carbonaedj beverages.

2. The Prior Art

A pre-examination search developed the following references:

Asbury—U.S. Pat. No. 3,246,791—April, 1966
Asbury—U.S. Pat. No. 3,355,058—November, 1967
Klein—U.S. Pat. No. 3,779,417—December, 1973
Perry—U.S. Pat. No. 3,843,011—October, 1974
Perry—U.S. Pat. No. 3,952,912—April, 1976
Perry—U.S. Pat. No. 4,062,471—December, 1977
Asbury—U.S. Pat. No. 4,078,693—March, 1978
Gynp, et al.—U.S. Pat. No. 4,078,694—March, 1978
Perry—U.S. Pat. No. 4,084,721—April, 1978
Amberg et al.—U.S. Pat. No. 4,210,256—July, 1980
Rossetti—U.S. Pat. No. 4,377,244—March, 1983

Container lids with integral tear tabs for forming pour openings in the lids are well known in the prior art including the patents identified above. Until the last few years, the most prevalent type of tear tab lid for beverage containers consisted of a two-piece construction having a finger-operated pull ring riveted to a portion of the lid delineated by a tab-defining score line. When the user pulls the ring away from the can, the ring and tab separate from the remainder of the lid thereby forming a pour opening in the lid for the container contents. The torn out tab is a metallic curl with sharp edges and is often carelessly disposed of creating a visual nuisance and a safety hazard. Also, that two-piece lid is relatively expensive to make involving, as it does, the riveting of a pull ring to the lid per se.

In an effort to respond to the objections raised against the aforesaid containers with separable tear tabs, a container lid was designed with a leverage ring that, when lifted, pushed a scored, tab-defining area of the lid into the interior of the container to form a pour or drink opening, with both the tab and the leverage ring remaining attached to the lid. An example of this type of container lid is disclosed in the above-identified U.S. Pat. No. 4,084,721 and the related references identified therein. While this lid solved the environmental problems associated with lids with separable tear tabs, it has not cut costs because it still requires the riveting of a separate leverage ring to the can lid.

It is only relatively recently that serious efforts have been made to develop a container lid with an integral tear tab scored into the lid which can be pushed in by the user's finger to form a drink or pour opening in the lid while remaining attached to the lid, examples of same being disclosed in the above-identified patents U.S. Pat. Nos. 4,078,694 and 4,377,244.

In the most common form of push-tab lid construction, an opening is formed in the lid which is closed by an integral tab hinged to the lid, the scored joint between the tab and the remainder of the lid being sealed on the inside by a plastic sealant material. As these containers often contain a carbonated beverage, there is substantial internal pressure acting against the underside of the tab. Consequently, the tab is usually made larger than the opening in the lid so that its edge margin engages under the lid to prevent the tab from being pushed out by the internal pressure.

Usually also, to facilitate pushing in the tab, the lid includes a smaller vent hole closed by a similar integral tab which can be pushed in to relieve the internal pressure before the larger tab is depressed to open the pour opening in the lid. This type of construction, however, has certain disadvantages militating against its wider use. More particularly, the consumer must be educated as to the correct way to open the can by pushing in the vent tab before the pour tab. This means that special instructions must be applied to the can for this purpose. Even then, two separate operations are required to open the container properly which is annoying to certain consumers.

Still further, the consumer must push down with his finger with a considerable force on the pour tab which is about the same size as the end of the finger before that tab will separate along its score line from the remainder of the lid. The exerting of the requisite force may be a problem for certain aged or infirm individuals. Most importantly, when the consumer does succeed in pushing in the pour tab, that tab tends to give way suddenly so that the consumer's finger often thrusts down into the pour opening where it can be cut by the sharp scored edge of that opening. Prospective purchasers perceive this unsanitary and dangerous potential which therefore inhibits consumer acceptance of the product. The only prior solution to that problem known to applicants involves folding back the edge of the opening on itself to round off the edge. However, that requires a separate forming operation on the lid which increases its overall cost.

SUMMARY OF THE INVENTION

Accordingly, the present invention aims to provide an improved container lid with an integral push-in tear tab.

Another object of the invention is to provide a container lid of this type which is easier for the consumer to open.

A further object of the invention is to provide a container lid with an integral push-in tear tab that protects the consumer's finger from the sharp edge of the pour opening exposed after the tab is pushed in.

Still another object of the invention is to provide a container lid with an integral push-in tear tab which permits the consumer to vent and open the container with a single push of the finger.

Another object of the invention is to provide a lid of this type which requires a minimum amount of force to push in the tear tab sufficiently to provide an opening of the requisite size to drain the container contents quickly.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the invention is a one-piece can or container lid with an integral embossed and scored push-in tear tab. The tab is scored around an end adjacent the rim of the lid to tear upon the application of a downward force applied by the consumer's finger in the area of the tab. The area of the score line extends around that end of the tear tab inwardly on both sides to a hypothetical or imaginary line extending across the lid. Actually, that line corresponds to a chord segment of the lid. Preferably, but not necessarily, the tab delineated by the score line is more or less triangular or nose-shaped. Preferably also, as will be described in detail later, means are provided in the lid for venting the container prior to opening it so that there will be no internal pressure to resist the depressing of the tab by the consumer's finger or thumb to form the drink or pour opening in the lid.

As is done conventionally in container tops of this type, the tab may be made larger than the pour opening in the lid so that, in the closed position, the edge margin of the tab engages the underside of the lid to prevent the tab from being pushed or blown upwards or outwards from the lid by gas pressure inside the container. In this event, a conventional plastic sealant material may be applied to the underside of the lid all along the tab-delineating score line to maintain the airtight integrity of the container prior to its opening.

In accordance with this invention, the container lid is stamped or embossed to form a continuous, relatively steep raised ridge in the portion of the lid defining the tear tab. The ridge extends along the tab between the score line at the edge of the tab and the area of the lid where finger force is applied in order to push in the tab to form the pour opening. This ridge thus defines the area on the lid where the opening force should be applied. It also functions as a barrier to separate or isolate the pushing finger from the score line. Consequently, the ridge prevents the consumer's finger from projecting into the pour opening and contacting the sharp scored edge of that opening exposed after the tab is pushed in. Still further, the ridge forms a beam that rigidifies the tab portion of the lid so that the tab separates reliably along its score line from the remainder of the lid when the consumer applies a reasonable downward digit force on the designated push area of the lid. Preferably, that push area is located behind the aforementioned hypothetical line which further helps to insure that the consumer's finger does not contact the exposed sharp edge of the pour opening.

To minimize the amount of force required to push in the tear tab, one preferred lid embodiment has a score or tear line which penetrates the lid along its entire length. Moreover, the tab delineated by that score line is prebent to establish a downward bias on the tab toward its open position. Then, while the tab is maintained in its upper position so that it closes the pour opening, sealant material is applied to the underside of the lid along the score line to retain the tab in that closed position and seal the opening. Thus, to push in the tab in order to open the container, the consumer only has to press down on the designated push area of the lid with enough force to fracture the sealant material. As soon as such fracture occurs, the container is vented and the tab springs to its open position. Thus, even weak or infirm individuals can open a container fitted with our lid of this type.

To facilitate opening the tear tab, it is desirable sometimes that the lid be stamped or formed with a relatively deep dimple, depression, or groove contiguous each end of the score line delineating the tab. The depression or depressions lies in the path of the score line and preferably extends from locations at or near the ends of the score line to areas of the lid behind the aforesaid hypothetical line defined by those ends. These depressions, together with the tab ridge, help to isolate the tab portion of the lid from the remainder of the lid so that the tab functions mechanically more or less independently from the remainder of the lid. Also, when a downward force is applied to the designated area of the lid to push in the tab, the depressions allow the tab to fold or buckle relative to the remainder of the lid so that the tab moves downwardly in the container to an appreciable extent in response to a minimum pushing force applied to the designated area of the lid.

In other words, the depressions function more or less as hinges permitting the tab to move downwardly relative to the area of the lid behind the aforementioned hypothetical line and outboard of those depressions. In effect, they extend the tab and resulting pour opening inwardly on the lid beyond the hypothetical line even though the score line that actually delineates the tab terminates at that line. Thus, the depressions permit the tab to be pushed further down to create a larger pour opening under a given pushing force than would be the case if the depressions were not present. Furthermore, they facilitate opening the can from a digit location on the lid behind the aforementioned hypothetical line that is removed from the sharp pour opening edge created after the tab is pushed in.

While having all of the aforesaid advantages, the present container lid is still relatively inexpensive to make. This is primarily because the tear tab is formed integrally with the lid by a simple stamping and scoring operation, unlike prior lids of this general type which require separate riveted parts in order to facilitate pushing in the tab or separate forming steps to round off the sharp scored edge of the resultant pour opening.

BRIEF DESCRIPTION OF THE DRAWING

For a fuller understanding of the nature and objects of the invention, reference should be had to the following detailed description, taken in connection with the accompanying drawing, in which.

DETAILED DESCRIPTION OF THE PREFERRED EMBODIMENTS

Figure 1:
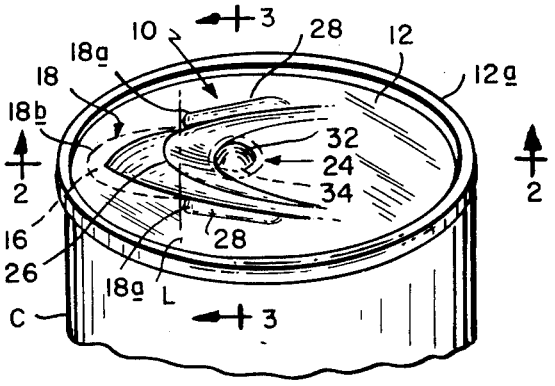
FIG. 1 is a fragmentary perspective view of a beverage can having a lid made in accordance with this invention.
Figure 2A:
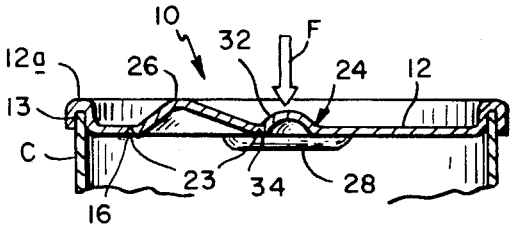
FIG. 2A is a sectional view taken along line 2—2 of FIG. 1.
Figure 2B:
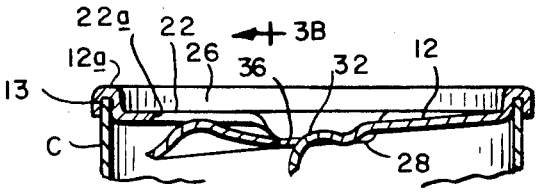
FIG. 2B is a view similar to FIG. 2A, but showing the lid tear tab in its open position.
Figure 3A:
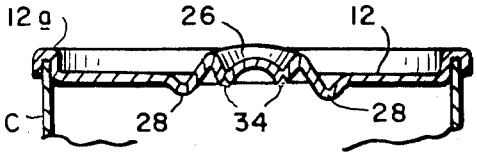
FIG. 3A is a sectional view taken along line 3—3 of FIG. 1.

Referring to FIGS. 1, 2A and 3A of the drawing, a conventional container C such as a beverage can is closed at the top by a lid indicated generally at 10 embodying our invention. The lid 10 comprises a disk 12 usually made of aluminum or steel metal, although it could be composed of plastic material, which is pressed onto the upper edge of container C in a known manner by the use of a rolled edge 12*a*. A plastic sealant material 13 is usually present at the joint between the lid and container. Lid 10 has in integral tear tab 16 which is delineated in disk 12 by a score or tear line 18. While the score or tear line 18 that demarks the tab may have a variety of different shapes, it is usually in the form of an open loop with the ends 18*a* of the line being located at spaced-apart locations on disk 12 which define a hypothetical or imaginary line corresponding to a segment of a chord L of disk 12. By the word "loop", we mean not only a single curved line, but also a line composed of a series of stright or curved line segments. Preferably, the score line has a midportion 18*b* which extends relatively close to the rolled edge 12*a* of the lid so that, when the tab 16 is pushed in, it forms an opening 22 (FIGS. 2B and 3B) in the lid which is relatively close to the lid edge so that the consumer can pour or drink the container contents readily through that opening 22. Thus, while lid 10 has a tab 16 which is more or less triangular in shape, the score line 18 could just as well define a tab which is circular or some other shape.

As best seen in FIG. 2A, the score line of the illustrated lid 10 is cut in the underside of disk 12, although the line could also be made in the upper surface thereof. In either event, the score line extends only part way through the disk so that sufficient material remains to prevent the disk from fracturing along the score line due to an accidental small downward force on tab 16 or due to the usual gas pressure inside container C. If the container is under high pressure, the disk 12 can be stamped and scored in the known way described above so that tab 16 is larger than the opening 22. In that event, the tear or score line 18 extends completely through disk 12 all along its length and the edge margin of tab 16 engages under the edge margin of the opening thereby preventing the tab 16 from being pushed upward or outward through opening 22 by the internal pressure. In that event also, a fracturable plastic sealant material 23 is applied to the underside of disk 12 along the score line to insure a fluid-tight seal between tab 16 and the remainder of disk 12 as is done on conventional "easy-open" or "pop-top" can lids of this general type.

The consumer opens container C by applying a finger or thumb to a designated area 24 on the disk lid 12 and pushing down. Area 24 may be designated by printing on the lid or by a dimple or bump stamped into disk 12 at that location. In lid 10 shown in FIG. 1, the push location or pressure point 24 is located on the opposite side of line L from score line 18. Therefore, when the consumer pushes in tab 16, the pushing digit is positioned away from the sharp torn edge 22*a* of opening 22 which is exposed after the tab is pushed to its open position shown in FIGS. 2B and 3B. This reduces the chances of the consumer's finger contacting and being cut by that edge.

Further as shown in FIGS. 1, 2A and 3A, tab 16 of lid 10 is stamped or formed with a raised ridge or beak 26 between the designated push location 24 and score line 18. The illustrated ridge 26 is more or less arrow shaped and symmetrically disposed on tab 16 so that it corresponds more or less to the generally triangular shape of that tab; however, the ridge could just as well be of some other shape that accomplishes the objectives assigned to it herein. The ridge 26 stamped into disk 12 constitutes a beam which makes tab 16 considerably more rigid than the flexible remainder of disk 12 so that tab 16 acts as a unit and from a mechanical standpoint functions independently of the remainder of disk 12. Ridge 26 also constitutes a physical barrier that prevents the consumer's finger from contacting the opening edge 22*a* during the act of pushing down on tab 16 in order to open the container. In other words, even if the consumer pushes down on tab 16 in front of line L near its free end rather than at the designated pressure point 24 at the root or base of the tab, the ridge 26 still prevents the finger from sliding to the free end of the declining tab into opening 22 and contacting the exposed opening edge 22*a*.

In addition to the raised ridge 26, a preferred embodiment of our lid is formed with a stamped dimple or depression 28 contiguous each end of score line 18. In the illustrated lid 10, there are two elongated semicylindrical depressions 28 in the path of the score line. They extend from locations at or near extending from the opposite ends 18*a* of score line 18 collinearly to locations on the opposite side of line L from the score line. In certain applications, the depressions may be wedge-shaped or triangular in plan view or a single straight or curved depression 28 extending across the disk 12 between the outboard walls of the illustrated depressions 28 may be appropriate. As will be described shortly, the depression or depressions 28 help to establish the aforementioned mechanical and functional independence of tab 16 from the remainder of disk 12 and facilitate the pushing in of the tab 16 to provide a large effective pour opening 22 in the lid.

Preferably lid 10 includes means for venting container C prior to pushing in tab 16 in order to relieve any internal pressure in a controlled manner. In the illustrated lid, a small raised or bumped tear tab 32 defined by a generally C-shaped score line 34 is present in the can lid preferably at the push location 24 where it is shielded by ridge 26 from accidental impacts. In fact, the raised tear tab 32 can itself define the location 24. Tear tab 32 can be scored out of disk 12 in the same way as tab 16 and its score line 34 joint sealed with sealant material 23 to insure the fluid-tight integrity of container C. Thus, when the consumer pushes down on the small area tab 32 at location 24, the disk 12 material will fracture along score line 34 and tab 32 will be pushed in to relieve any internal pressure through the resultant vent hole 36 before the pour tab 16 is depressed. Thus, unlike prior container lids equipped with tiny tear tabs for venting purposes at unprotected locations away from the pour opening, and which require two pushing operations in order to open the can properly, only a single pushing action is required to both vent and open container C equipped with our lid 10.

Instead of providing lid 10 with a separate vent tab 32, the score line portion 18*b* adjacent the rim of disk 12 can be formed deeper or can extend entirely through the disk and be covered with sealant 23. Consequently, when the consumer pushes down on the lid at the pushing location 24, the sealant 23 and any disk material present there will fracture readily thereby venting the container and enabling tab 16 to be depressed easily. Thus, with this lid version also the container C is vented and opened readily by a single push on lid 10. Of course, in those applications where single step opening is not essential, vent tab 32 can be located elsewhere on lid 10 than at the push location 24.

Figure 3B:
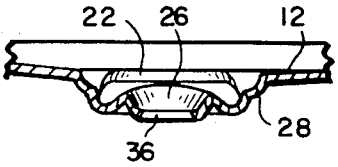
FIG. 3B is a view similar to FIG. 3A but showing the tab in its open position.

Referring now to FIGS. 2A, 2B, 3A and 3B, the user opens container C by applying a downward force F to push location 24 with a thumb or finger. That force pushes in tab 32 or fractures the score line segment 18*b*, thereby venting the container as described above. Thus, container C does not have any internal pressure to resist the depressing of tab 16. The downward force F applied to location 24 also suffices to fracture the sealant 23 and any remaining disk 12 material along score line 18. Thus, tab 16 tears away or separates from the remainder of disk 12 all along the score line from line segment 18*b* at the free end of tab 16 to the score line ends 18*a* at the root of the tab. Whereupon, the portion of disk 12 outboard of ridge 26 and behind line L flex or bend so that tab 16 is depressed below the nominal plane of disk 12, thereby forming the pour opening 22 in lid 10 as shown in FIGS. 2B and 3B. With the formation of that opening, the opening edge 22*a* is exposed. However, it presents no danger to the digit applying the opening force F because the push location 24 is located relatively remote from edge 22*a* behind line L. Moreover, even if the pushing force F is applied at a push location 24 in front of line L, the relatively steep intervening ridge 26 constitutes a barrier that prevents the force-applying finger from sliding along the declining tab 16 through opening 22 and contacting the edge 22*a*.

As noted above, ridge 26 rigidifies tab 16 so that it does not curl or bend when pushed into the container and in that respect, it causes the tab to function differently from the remainder of the flexible flat disk 12. That factor plus the presence of the depressions 28 causes the tab 16 to deflect downwardly further into container C forming a larger opening 22 than would be the case in the absence of the depressions. More particularly, the stamping of those depressions or dimples apparently stretches the disk 12 at those locations, thereby reducing its thickness to some extent and making the disk more flexible at those locations. Consequently, as best seen in FIGS. 3A and 3B, the walls of depressions 28 unfold or buckle downwardly under force F allowing the portions of disk 12 inboard of the depressions and behind line L to hinge or move downwardly at the depressions into container C. Thus, the rigid tab 16 is depressed further than it would be due to simple flexing of the disk 12 if the depressions were not present. In effect, then, the depresions 28 increase the length of tab 16 and the size of opening 22 without extending the score line 18 behind line L. Resultantly, the opening edge 22*a* never approaches location 24 where the consumer's finger normally pushes. In short, then, the depressions 28 insure that an adequately sized pour opening 22 is obtained with a given pushing force F without endangering the digit applying that force.

The amount of the hinging action that occurs at depressions 28 depends to a great extent upon the depth of those depressions. Also, in some cases, the disk 12 material tears laterally slightly at the ends 18*a* of the score line where those ends join depressions 28. However, after tab 16 has been depressed so as to straighten the walls of each depression 28 beyond a certain amount, further flexing is inhibited by the ridge 26. Therefore, the distance to which tab 16 can be pushed into the container can be controlled to some extent by controlling those depressions. In this way, tab 16 can be prevented from bending or rotating into container C to such an extent that the consumer's finger may tend to slide over the tab ridge 26 into the opening edges 22*a*. Generally also, the depressions 28 tend to inhibit propagation of tear line 18 beyond the ends 18*a* as the tab is being bent downwardly to its fully open position illustrated in FIGS. 2B and 3B.

In some applications, it may be desirable to form tab 16 with a built-in downward or inward bias so that the container can be opened even by a weak or infirm individual. In this event, the score or tear line 18 is cut completely through disk 12 and the tab 16 made larger than opening 22 so that its edge margin engages the underside of the lid around that opening as described above. The tab 16 is then pushed down out of the nominal plane of the lid to its open position shown in FIG. 2B. Following this, the tab is bent back so that it engages the underside of disk 12 and a sealant material 23 is applied to the underside of the disk all along the score line 16 to retain the tab in that position and to bridge and seal the joint around the tab. Thus the tab now has an internal downward bias. When a container C is fitted with such a lid, the consumer only has to push down at the pushing location 24 with enough force to fracture the sealant material 23. An actual tearing of the lid material along the score or tear line 18 is not required. Furthermore, the downward bias now inherent in tab 16 actually assists in the opening of the container.

Figure 4:
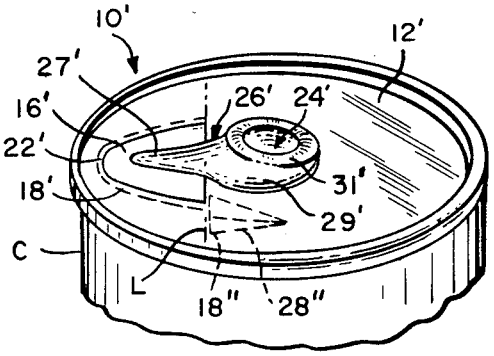
FIG. 4 is a view similar to FIG. 1 of a second container lid embodiment.

Refer now to FIG. 4 which shows a somewhat different container lid embodiment 10' embodying features of our invention. Lid 10' is similar in many respects to lid 10. It includes a disk 12' and a tab 16' embossed and scored through at 18' to be larger than the pour opening 22' in the disk to prevent blow out as described above. A raised ridge 26' is stamped or embossed into the disk 12'. The ridge includes a narrower end or beak 27' which terminates proximate the midportion of score line 18' and a wider end or base 29' rearwardly of line L near the center of the lid. A concave, digit-receiving push location 24' is present at the ridge base 29'. As seen in FIG. 4, the floor of that location is lower than ridge 26' as a whole such that there is an upwardly inclined ridge portion 31' created which prevents the digit from sliding out of location 24' forwardly of line L when tab 16' is pushed down into the container. As noted above, this minimizes chances of injury to the finger caused by contact with the exposed edge of the pour opening 22'. While lid 10' does not include the depressions 28 present in lid 10, depressions can be stamped into the lid 10' to obtain the same advantages discussed above.

It will be seen from the foregoing, then, that our container lids with integral push-in tear tabs can be made relatively inexpensively by a simple stamping and scoring operation. The embossing and indenting of the illustrated can lids required to form the raised and depressed areas in disks 12 do not require deep draws with difficult corners so that the rejection rate for the lids should be relatively low. Moreover, these lids can be installed on conventional containers C in the customary way so that they do not add appreciably to the overall costs of the containers. Yet the lids can be opened with a single pushing operation even by relatively weak or infirm individuals. For all these reasons, the lids should find wide acceptance in the marketplace.

It will thus be seen that the objects set forth above, among those made apparent from the preceding description, are efficiently attained. Also, certain changes may be made in the above constructions without departing from the scope of the invention. For example, the ends of the score line may extend outward for a distance along line L and triangular depressions may be provided at or near those outward extensions as shown in phantom at 18" and 28" at one end of line 18' in FIG. 4. Therefore, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. A container lid to be opened by finger pressure formed from a deformable plate by inscribing a tear-line in the plate so as to defined a tab in the plate of a size to receive a digit and an opening force applied thereby and deforming the plate to provide a depression at or near each end of the tear-line so that upon application of a downward pressure at a selected locations on the plate, said tear-line tears along its length and said plate hinges or bends at said depressions whereby said tab is displaced a substantial distance from the nominal plane of the lid and exposes a relatively large opening in the lid.

2. The lid defined in claim 1 wherein said depression is generally triangular in plan view.

3. The lid defined in claim 1 wherein said plate is embossed and scored to defined a vent tab at a selected location on the lid.

* * * * *